US008117855B2

(12) United States Patent
Rafalovich

(10) Patent No.: US 8,117,855 B2
(45) Date of Patent: Feb. 21, 2012

(54) REFRIGERATION SYSTEM WITH CONSECUTIVE EXPANSIONS AND METHOD

(76) Inventor: Alexander P Rafalovich, Sarasota, FL (US)

( * ) Notice: Subject to any disclaimer, the term of this patent is extended or adjusted under 35 U.S.C. 154(b) by 0 days.

(21) Appl. No.: 12/709,027

(22) Filed: Feb. 19, 2010

(65) Prior Publication Data

US 2011/0203300 A1 Aug. 25, 2011

(51) Int. Cl.
*F25D 17/06* (2006.01)
*F25B 41/00* (2006.01)
*F25B 13/00* (2006.01)

(52) U.S. Cl. ..... 62/90; 62/93; 62/113; 62/513; 165/62

(58) Field of Classification Search ..... 62/90, 93, 62/113, 115, 498, 513, 324.6; 165/62
See application file for complete search history.

(56) References Cited

U.S. PATENT DOCUMENTS

| | | | | |
|---|---|---|---|---|
| 4,631,926 | A | 12/1986 | Goldshtein et al. | |
| 5,664,425 | A | 9/1997 | Hyde | |
| 5,689,962 | A | 11/1997 | Rafalovich | |
| 5,755,104 | A | 5/1998 | Rafalovich et al. | |
| 6,595,012 | B2 * | 7/2003 | Rafalovich | 62/92 |
| 6,658,874 | B1 | 12/2003 | Trent | |
| 6,701,723 | B1 | 3/2004 | Dobmeier et al. | |
| 6,862,892 | B1 | 3/2005 | Meyer et al. | |

FOREIGN PATENT DOCUMENTS

JP 09053865 A * 2/1997

* cited by examiner

*Primary Examiner* — Chen Wen Jiang

(57) ABSTRACT

Modernized refrigeration cycle includes two consecutive expansions with two expansion devices and two condensers, wherein the first condenser liquefies refrigerant after compressor and the second condenser liquefies refrigerant after the first expansion device. The cooling medium for the second condenser is either air to be conditioned in the refrigeration system or another available medium. Invention presents sealed systems of air conditioners, dehumidifiers and heat pumps operating per aforementioned refrigeration cycle that allows enhanced dehumidification with efficiency improvement in cooling mode and heating capacity and efficiency increase in heating mode.

19 Claims, 14 Drawing Sheets

REFRIGERATION SYSTEM WITH CONSECUTIVE EXPANSIONS AND METHOD

BACKGROUND OF THE INVENTION

The present invention relates to refrigeration climate control systems, the systems that either absorb heat from indoor air and reject it to ambient or deliver heat absorbed from ambient to indoor air. Those systems include residential and commercial heat pumps and air conditioners. Invention also relates to refrigeration systems with air circulating in an enclosed volume. Those systems include, for example, dehumidifiers and heat pumps for clothing dryers.

Air conditioners/heat pumps, and dehumidifiers operate conventional refrigeration cycle (FIG. 2) and in a cooling mode extract heat from indoor air and condense moisture from this air, delivering extracted heat along with heat from the compressor to ambient. For air conditioners and heat pumps, ambient is normally outdoor air or other outdoor media. For dehumidifiers ambient is same indoor air. In cooling mode heat pumps and air conditioners reduce temperature and humidity of the indoor air to a comfortable level while dehumidifiers reduce humidity increasing indoor air temperature. For air conditioners and heat pumps, a set of indoor air temperature and airflow rate through the evaporator together with a given indoor air exchange rate and conditions of outdoor air will also define indoor air humidity. When air conditioner/heat pump operates in the cooling mode, average indoor air relative humidity (RH) can stay in comfortable level of around 35-50%. However, even with average indoor air humidity of 50% or below RH of chilled air leaving evaporator may reach 90-95%. Air with such high humidity carries small water drops that accumulate on air duct surfaces or even on the walls inside of a building that may result in mold and allergies. Reduction in airflow through the indoor heat exchanger (evaporator), or reduction in the evaporator dimensions, or heating air after the evaporator with an additional heater or with a condensing coil may reduce indoor air humidity, but with considerable up to 15-20% reduction in cooling capacity and efficiency of air conditioning. Besides, during summer time in many places with high outside air temperature and humidity and with increased indoor air exchange (i.e. old buildings, open windows or doors) average indoor air relative humidity may rise far above 50% and even 70%. Thus, the danger of water accumulations in air ducts and on the walls can be even higher and will require adding to leaving evaporator air considerable heat.

Climate controlling heat pumps operating in a heating mode extract heat from outside air and deliver this heat together with heat from compressor to the indoor heat exchanger while heat pumps in dryers reheat circulating air. A fan blowing air through the warm heat exchanger coil transfers heat to air. Concerning climate control systems in warm regions such as, for example, Florida, most of the time heat pumps provide sufficient indoor air temperatures through wintertime. However, in colder regions, heat pumps often require additional gas or resistance heaters, and generally are not efficient with low outdoor temperatures.

One solution to improve heat pump operations in the heating and cooling modes, also as air conditioner in cooling mode has been presented in U.S. Pat. No. 5,689,962. The patent offers schematics in which an indoor heat exchanger is divided in two parts. In the heating mode the first part becomes a condenser the second is a subcooler. In the cooling mode the first part of the heat exchanger is a subcooler and the second is an evaporator. The design problems are how to properly operate "subcooler" and what way to split indoor heat exchanger into two parts. If the parts are equal or approximately equal, the heat pump will operate inefficiently in both modes. If one part is much larger than another, heat pump is extremely inefficient in a mode where subcooler is larger than the evaporator or condenser. Concerning the method for dehumidifying and cooling air, there is only one refrigerant expansion before the subcooler, thus the subcooler works as a part of the evaporator. Lack of any expansion in the method for heating air makes the system not operable.

More specifically, U.S. Pat. Nos. 6,212,892 and 6,595,012 offer a refrigeration cycle with two expansions (see FIG. 3) for a heat pump. The cycle first has been introduced by the author of the present invention in an application for U.S. Pat. No. 5,755,104 to improve efficiency of refrigeration system with a thermal storage. Further, the cycle with cascade expansions was used in U.S. Pat. Nos. 6,212,892 and 6,595,012. As in the initial patent in these patents the cycle with two consecutive expansions has been offered exclusively for air conditioner or heat pump in cooling indoor air modes but not for the heating mode of a heat pump. Both patents specify two different cooling modes: conventional and with enhanced dehumidification. In dehumidification mode that operates the cycle of FIG. 3 both patents consider that auxiliary coil works as a subcooler. It implies that independently on expansion in the first expansion device the system would operate with efficient subcooling. This is an incorrect assumption. Insufficient subcooling may greatly affect efficiency of the system. For proper subcooling, refrigerant charge of the system is supposed to be higher than without subcooling. However, increased refrigerant charge will be collected in an accumulator or, in a worse case, excessive liquid refrigerant may reach the compressor, causing liquid slugs. Thus, practically it's very difficult to get condensing and deep subcooling in a heat transfer coil with a conventional geometry. As a consequence, offered in these patents design may increase condensing temperature and considerably reduce efficiency of the system. Also, as in U.S. Pat. No. 5,689,962, U.S. Pat. Nos. 6,212,892 and 6,595,012 don't specify dimensions of the auxiliary coil. Besides, U.S. Pat. Nos. 6,212,892 and 6,595,012 offer a second reversing valve turning on and off to alternate the conventional cooling mode with the mode with enhanced dehumidification. This brings additional installation, operating, and maintenance expenses.

SUMMARY OF THE INVENTION

In this invention, as opposed to conventional refrigeration systems including air conditioners, heat pumps, dehumidifiers, etc., refrigeration cycle is modernized and includes two consecutive expansions with two expansion devices and two condensers, wherein the first condenser liquefies refrigerant after compressor and the second condenser liquefies refrigerant after the first expansion device. The cooling medium for the second condenser is either air to be conditioned in the refrigeration system or other available medium. First embodiment of the present invention describes this refrigeration cycle.

Other embodiments include schematics and sequence of operations of sealed systems of air conditioners, dehumidifiers, and heat pumps in either cooling and/or heating modes working according to aforementioned refrigeration cycle. Included in the embodiments second condenser's dimensions limitations and general design requirements are based on the results of math modeling of an air conditioner and/or heat pump operating with cascade expansions. That allows enhanced dehumidification with efficiency improvement in cooling mode and capacity and efficiency increase in heating mode.

Yet another embodiment includes a valve to bypass second expansion device that allows air conditioner operations according to conventional refrigeration cycle.

DESCRIPTION OF THE PREFERRED EMBODIMENTS

Figure 1:
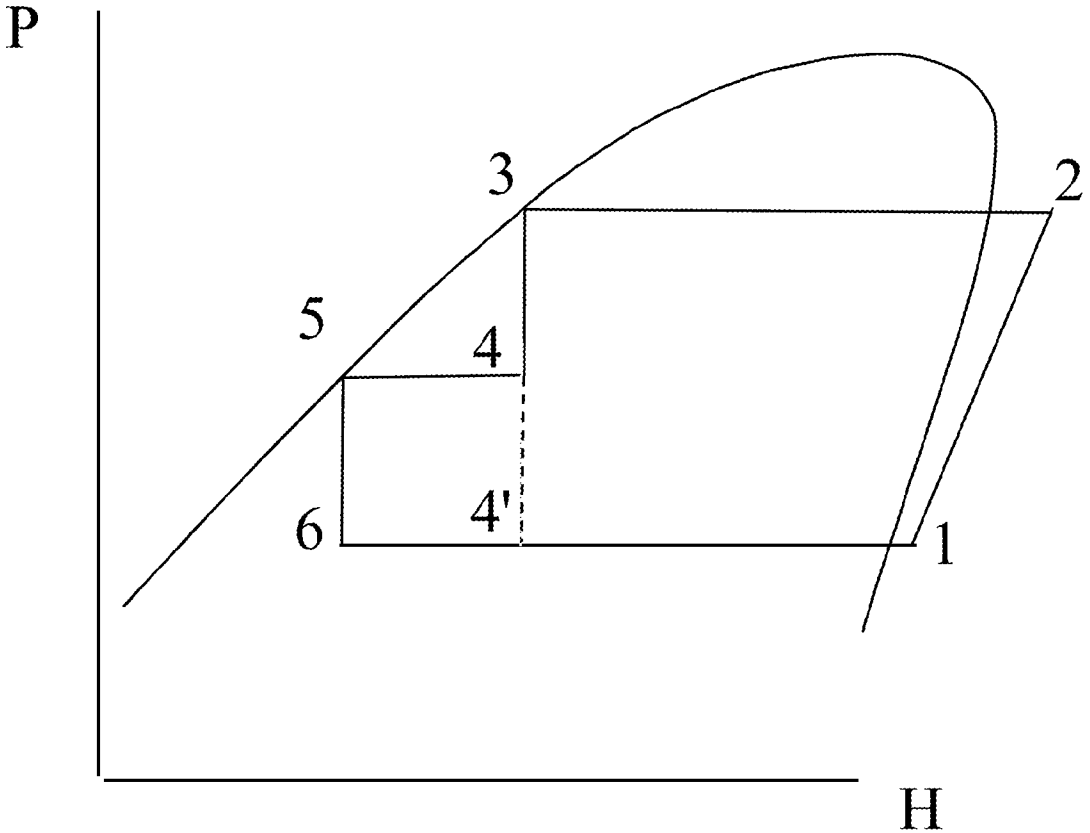
FIG. 1 is a P-H diagram of a modernized refrigeration cycle for conditioning air with two cascade expansions and two condensers.

FIG. 1 shows a P-H diagram of a refrigeration cycle with two consecutive expansions and two consecutive condensers.

Line 1-2-3-4-5-6-1 depicts the cycle where line 1-2 represents vaporized refrigerant compression in a compressor, line 2-3 represents desuperheating and condensing refrigerant in a first condenser, line 3-4 represents expansion in a first expansion device, line 4-5 condensing in a second condenser, line 5-6 shows expansion in a second expansion device, and line 6-1 shows evaporating in an evaporator. Evaporator capacity increase compared to the conventional cycle without any subcooling is shown by section 6-4'. In heating mode it also translates to an increase in heat delivered to the indoor coil.

In all-air systems a heat sink for the cooling mode is ambient air where the first or main condenser rejects heat. The second condenser requires a heat sink with lower temperature. It may be cold air after the evaporator that is delivered to the second condenser to condense refrigerant partly expanded in the first expansion device. Thus, for cooling mode it is most convenient to have the second condenser as a section of the indoor heat exchanger with air flowing first against the evaporator and then against the second condenser.

To use extra heat that the evaporator gets from ambient in the heating mode, the second condenser also has to be installed inside heating area to be a part of the indoor heat exchanger. Unlike the cooling mode, here cold air in the indoor heat exchanger first flows through the second condenser, and then air flows through the first condenser. In another arrangement cold air initially flows in parallel through the second condenser and part of the first condenser.

Figure 2:
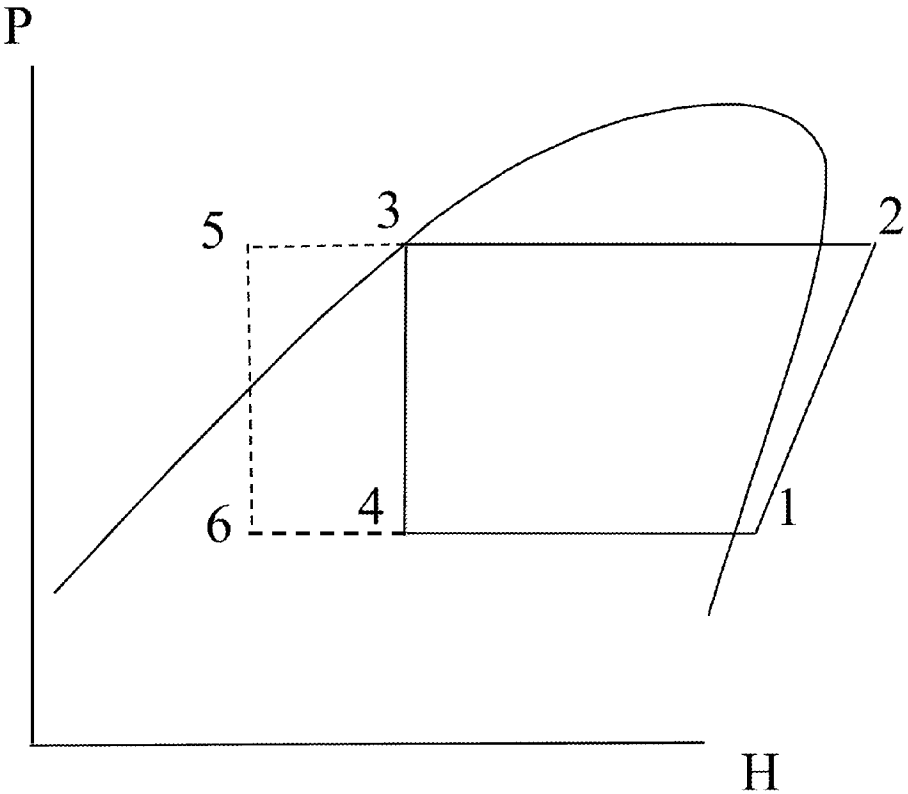
FIG. 2 (previous arts) is a P-H diagram of a conventional refrigeration cycle.

Line 1-2-3-4-1 in FIG. 2 demonstrates a conventional refrigeration cycle. Conventional cycle with subcooling after condenser is shown by line 1-2-5-6-1. Theoretically cycle 1-2-5-6-1 achieves the same effect as a modernized cycle of FIG. 1. Still, it's practically impossible to get deep subcooling in a condenser operating according to the conventional cycle. Normally, subcooling in the condenser rarely exceeds 1-3 deg. F. There are literature sources suggesting that deep subcooling may be reached with extra refrigerant charge. Condenser is supposed to liquefy refrigerant vapor in the first part of the heat transfer coil, leaving considerable part of the coil filled with liquid that may be subcooled by incoming cold air. However, increased refrigerant charge may be collected in an accumulator or, in a worse case, excessive liquid refrigerant may reach the compressor, thus causing a liquid slug.

Figure 3:
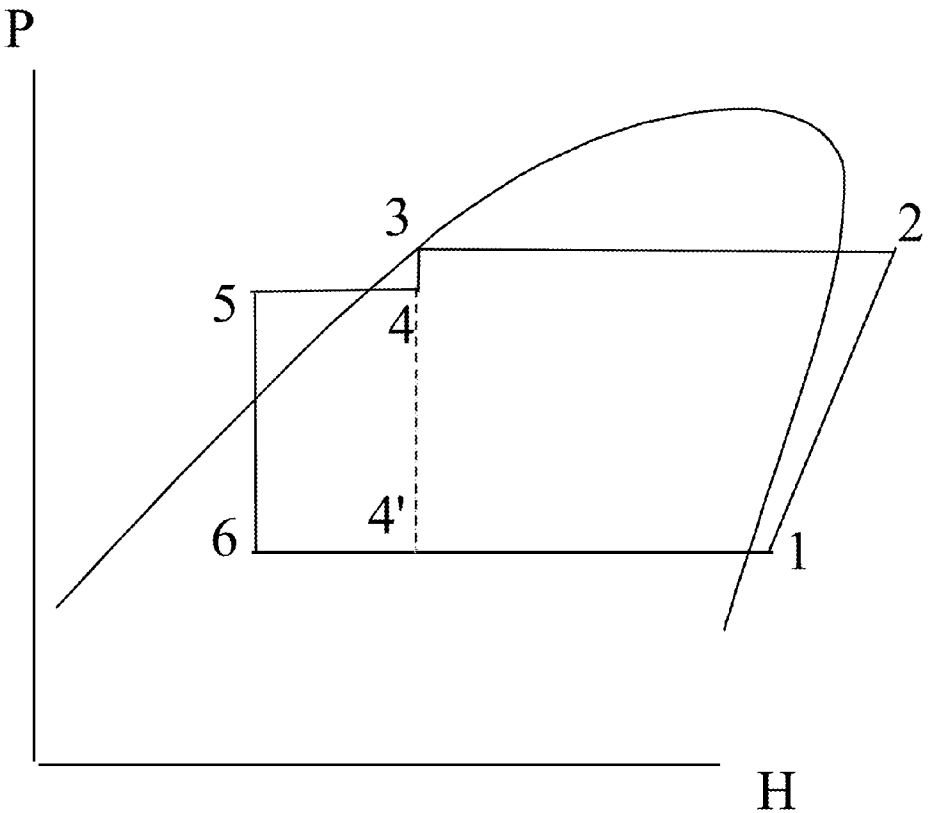
FIG. 3 (previous arts) is a P-H diagram of a refrigeration cycle with cascade expansions and an auxiliary subcooler.

In refrigeration cycle of FIG. 3 line 1-2 represents refrigerant vapor compression, line 2-3 shows desuperheating and condensing in a condenser, line 3-4 expansion in a first expansion device, line 4-5 condensing and subcooling in a subcooler, line 5-6 shows expansion in a second expansion device, and line 6-1 liquid refrigerant evaporation in an evaporator. Same as in the conventional refrigeration cycle, to achieve deep subcooling in the subcooler additional refrigerant charge is required.

Advantage of the cycle of FIG. 1 compared to the conventional cycle of FIG. 2 (with subcooling) and cycle of FIG. 3 is stability of condensing process. First expansion device controls the first (main) condenser. The second expansion device controls additional heat rejected in the second (auxiliary) condenser. This arrangement doesn't require refrigerant overcharge, providing considerable capacity and efficiency increase in the heating mode, and improved dehumidification together with efficiency in the cooling mode.

Figure 4:
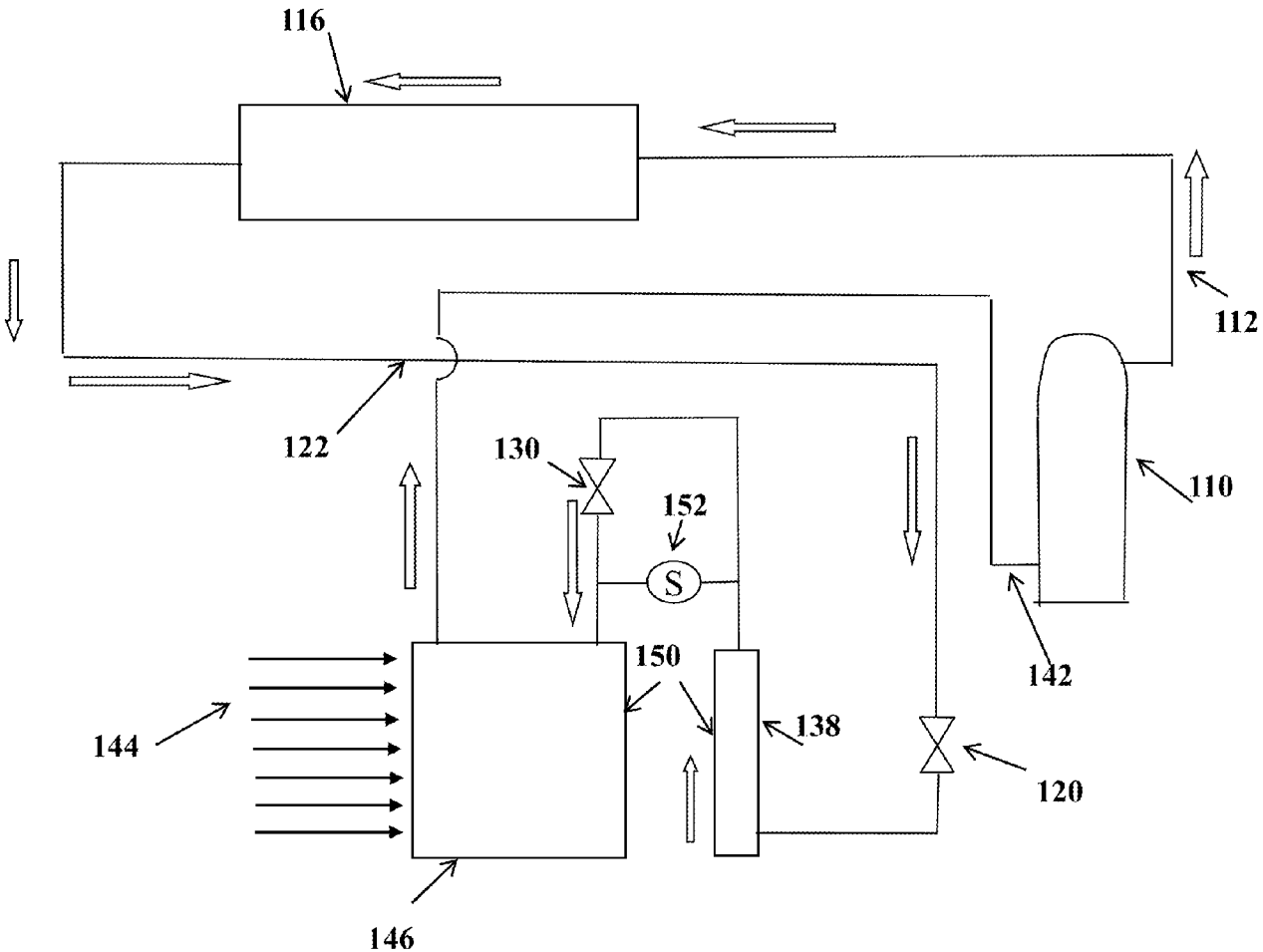
FIG. 4 is a schematic of an air conditioner according to one embodiment of the invention.

FIG. 4 depicts schematics of a sealed system of an air conditioner operating according to FIG. 1. Hot compressed refrigerant vapor after compressor 110 through line 112 flows to outdoor heat exchanger 116 that operates as a first condenser desuperheating and condensing refrigerant vapor. After the first condenser 116 liquid refrigerant through line 122 flows to the first expansion device 120. The device 120 can be an orifice, valve, thermostatic expansion valve, capillary tube, piston type short tube restrictor or any other device that expands refrigerant flowing in the direction of indoor heat exchanger 150. Indoor heat exchanger 150 consists of 2 sections: an auxiliary section 138 that operates as a second condenser and a main section 146 that operates as an evaporator. A mixture of vapor and liquid refrigerant expanded in device 120 reaches second condenser 138 wherein it liquefies, rejecting heat to indoor air that left the evaporator. After second condenser 138 liquid refrigerant reaches a second expansion device 130 which, like the first expansion device can be an orifice, valve, thermostatic expansion valve, capillary tube, piston type short tube restrictor or any other device that expands refrigerant flowing in the direction of main section 146 of the indoor heat exchanger 150. Expansion device 130 may also be combined with a distributor (not shown), if evaporator includes several parallel refrigerant passes. Mostly liquid refrigerant evaporates in evaporator 146, absorbing heat and condensing moisture from incoming indoor air 144. After evaporator 146, vaporized refrigerant through line 142 flows to suction of compressor 110. Optional solenoid valve 152 to bypass second expansion device 130 can be installed. When solenoid valve 152 is in an open position, an auxiliary section 138 of indoor heat exchanger 150 will work as a first part of the evaporator, evaporating refrigerant after the first expansion device 120.

In some applications heat exchanger 116 could be also located indoors. If air from same enclosed volume passes in series through both heat exchanger 150 and heat exchanger 116, the sealed system of FIG. 4 can be used in dehumidifiers for dehumidifying indoor air or in heat pumps for cloth dryers to provide air with additional heat needed to dry clothing. In a cloth dryer, auxiliary section of heat exchanger 150 may be located either after the first condenser or in a separate loop to reject extra heat from the system. Besides articles shown in the schematics, sealed system of FIG. 4 also may include filter, dryer, accumulator, and other common sealed system parts.

Figure 5:
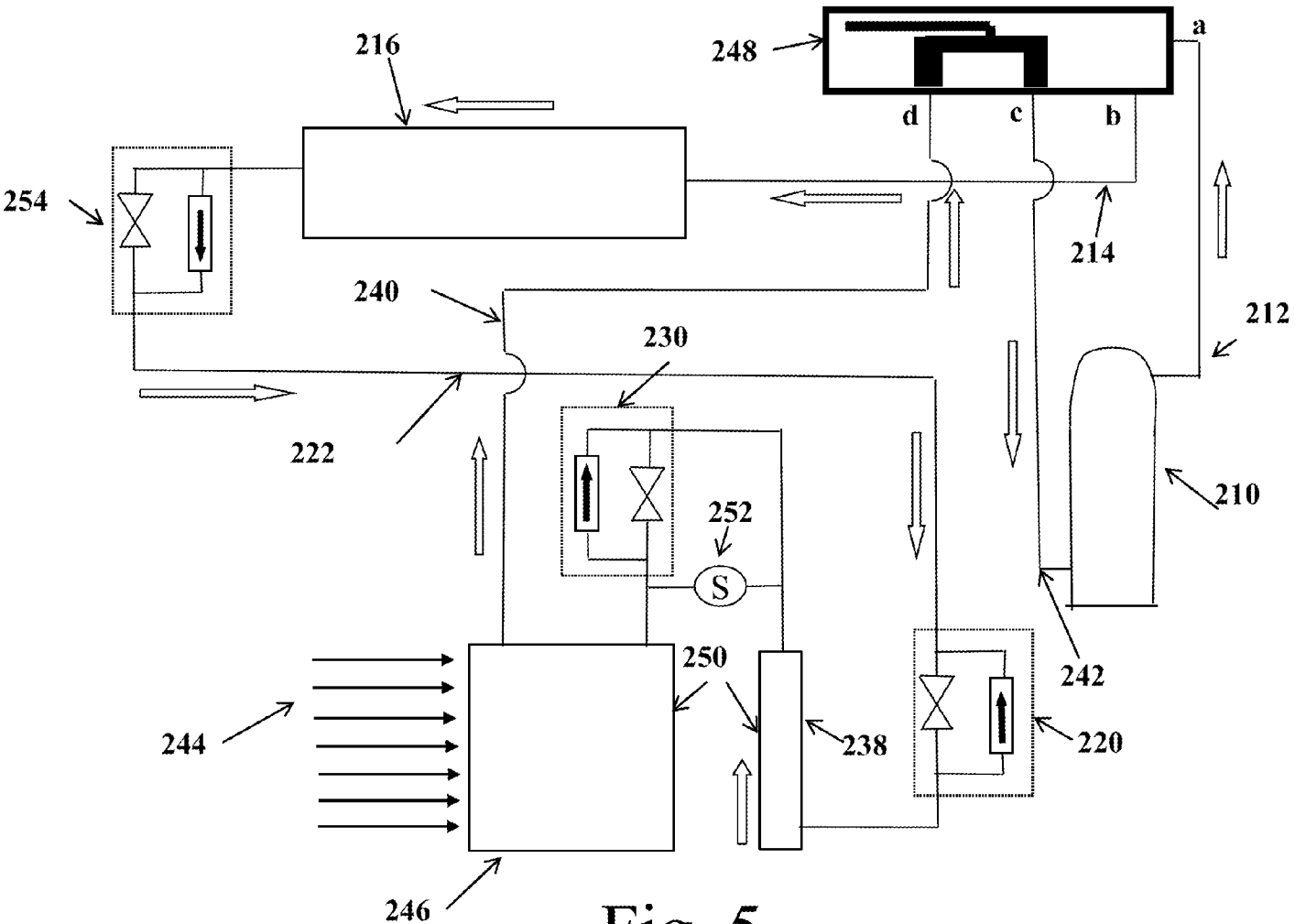
FIG. 5 is a schematic of a heat pump operating in cooling mode per refrigeration cycle of FIG. 1.

FIG. 5 depicts a sealed system of a heat pump operating in cooling mode. Excluding 4-way reversing valve 248, the heat pump operations are mostly identical to operations of air conditioner of FIG. 4. Hot compressed vapor refrigerant after compressor 210 flows through line 212 to port a of 4-way reversing valve 248. In the cooling mode, refrigerant from port a flows to port b and further through line 214 to outdoor heat exchanger 216 that in this mode operates as a first condenser, desuperheating and condensing refrigerant vapor. After the first condenser 216, liquid refrigerant flows through a third expansion device 254 to line 222 and further to the first expansion device 220. In this mode, the third expansion device allows refrigerant to flow to line 222 without expansion. On the contrary, first expansion device 220 expands refrigerant flowing in this direction so that partly vapor and partly liquid refrigerant reaches an indoor heat exchanger 250. Indoor heat exchanger 250 consists of 2 sections: a first (auxiliary) section 238 that operates as a second condenser and a second (main) section 246 that operates in this mode as an evaporator. First, refrigerant expanded in device 220 reaches second condenser 238 wherein it liquefies, rejecting heat to indoor air that left the evaporator. After condenser 238 liquid refrigerant reaches a second expansion device 230 that expands refrigerant flowing in the direction of main section 246 of the indoor heat exchanger 250. Then, mostly liquid refrigerant evaporates in evaporator 246 absorbing heat and condensing moisture from incoming indoor air 244. After evaporator 246, vaporized refrigerant flows to port d of 4-way reversing valve 248 through line 240. In this mode port d is connected to port c that, in turn, delivers vaporized refrigerant to the suction of compressor 210 through line 242. The design of any of three expansion devices may include a cap tube, an orifice, or thermostatic expansion valve with an additional check valve allowing free refrigerant movement in one direction. It could also be a short tube restrictor or any other expansion device that expands refrigerant in one direction and allows free flow in an opposite direction. Optional solenoid valve 252 to bypass the second expansion device 230 also can be installed. When solenoid valve 252 is in an open position, an auxiliary section 238 of indoor heat exchanger 250 will work as a first part of evaporator, evaporating liquid refrigerant after the first expansion device 220. In some heat pumps, where, for example, indoor and outdoor heat exchangers are in proximity, the third and the first expansion devices could be combined in one apparatus that expands refrigerant in cooling mode in one direction and in heating mode in the opposite direction. The second expansion device 230 may be combined with a distributor (not shown), if the evaporator includes several parallel refrigerant passes. In addition, sealed system of this heat pump as others described in the present invention may include filter, dryer, accumulator, and other sealed system parts.

Figure 6:
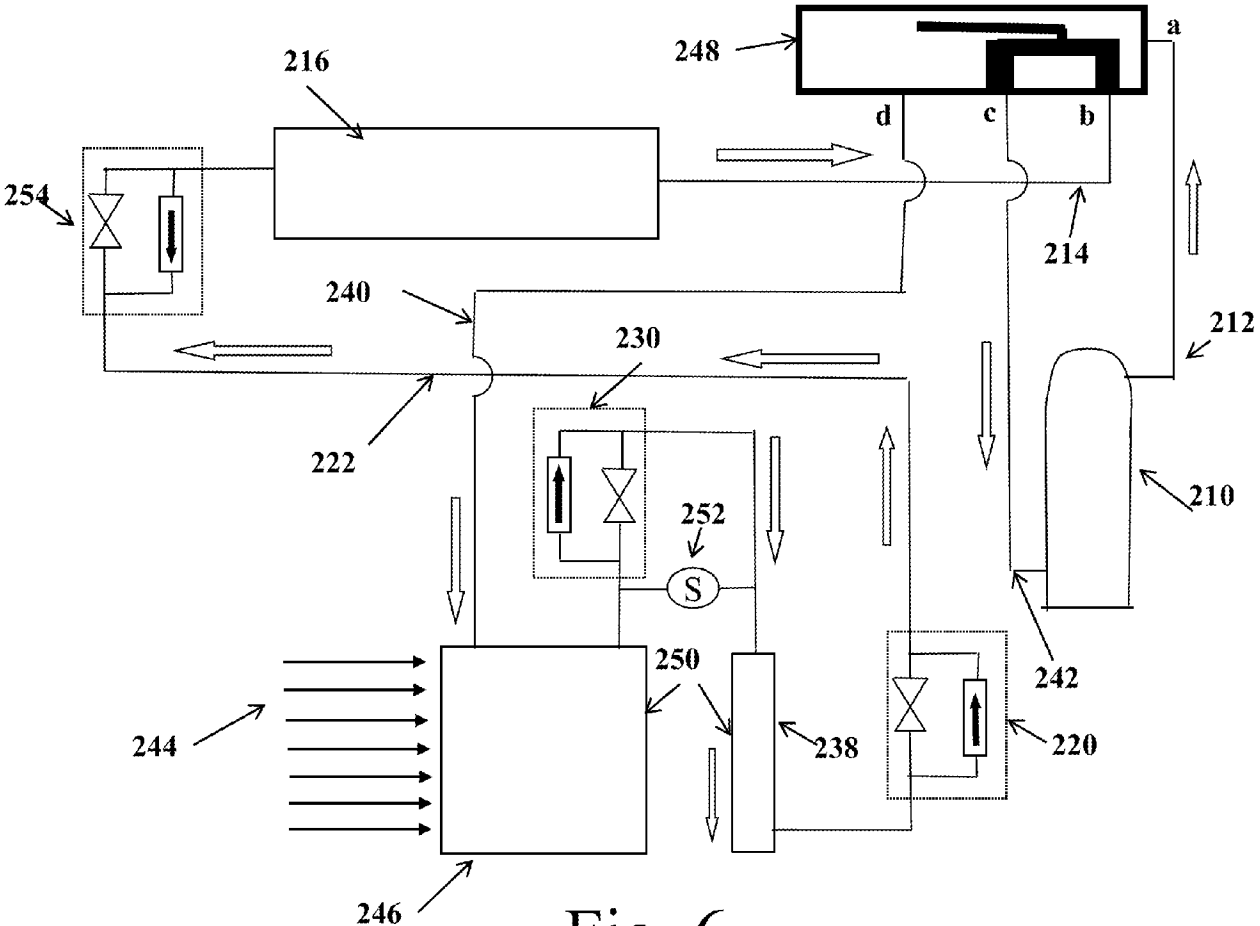
FIG. 6 is a schematic of the heat pump of FIG. 5 operating in heating mode.

FIG. 6 shows refrigerant path in the sealed system of heat pump of FIG. 5 operating in heating mode. Hot refrigerant vapor flows from discharge port of compressor 210 through line 212 to port a of 4-way valve 248. In this mode refrigerant after port a flows to port d and further through line 240 to the main section 246 of the indoor heat exchanger 250. After main section 246, refrigerant moves to auxiliary section 238 of heat exchanger 250 through a second expansion device 230. In this direction expansion device 230 allows refrigerant flowing without expansion. Both sections 246 and 238 of heat exchanger 250 work as a single condenser, condensing refrigerant vapor and rejecting heat to indoor airflow 244. After condensing, liquid refrigerant passes the first expansion device 220 also without expansion and through line 222 reaches the third expansion device 254. After expansion in device 254, mostly liquid refrigerant flows to outdoor heat exchanger 216, which in this mode operates as an evaporator. After evaporator, vaporized refrigerant through line 214 and port b of reversing valve 248 moves through port c and line 242 to suction port of compressor 210. Thus, in this mode heat pump operates according to the conventional refrigeration cycle depicted in FIG. 2.

Figure 7:
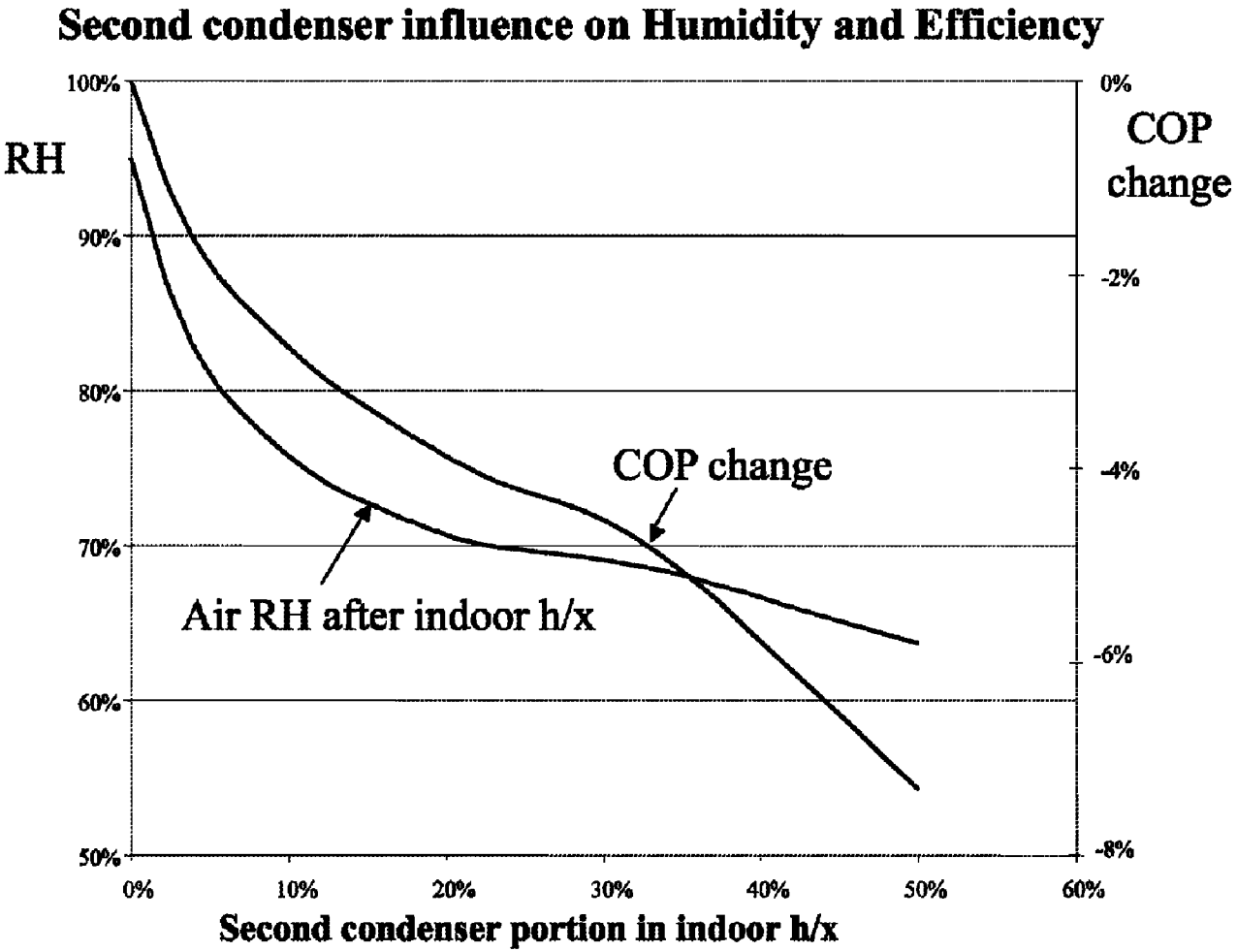
FIG. 7 presents results of math modeling of efficiency and relative humidity of air conditioner of FIG. 4 and heat pump of FIG. 5.

FIG. 7 represents results of math modeling of operations of air conditioner of FIG. 4 and heat pump of FIG. 5 in cooling mode. An important design parameter is what portion of indoor heat exchanger shall be used as an auxiliary section or as the second condenser. The rest of the indoor heat exchanger is the main section or in this mode, the evaporator. The assumptions include: average indoor air temperature is 75 deg. F. with relative humidity of 50%, refrigerant is R410A, evaporating temperature is 50 deg. F. As it can be seen from FIG. 7 when operating in conventional refrigeration cycle (percentage of the second condenser surface equals 0%) air relative humidity RH at the exit is around 95%, which is extremely high and will cause water drops in air after the evaporator. Analysis of the chart of FIG. 7 helps in finding proper range of ratio between the auxiliary section and main section of the indoor heat exchanger. The chart demonstrates that, if the second condenser takes only 5%-6% of the total indoor heat exchanger surface, relative humidity of air leaving indoor heat exchanger drops by 15-16% and reaches a safe level of 80% or below. Large drop in air RH can be explained by 2 factors. First is an additional load on the evaporator (see FIG. 1, section 6-4' of line 6-1). This extra load forces lowering of evaporating temperature, which, in turn, increases moisture condensation. Model shows that even small (5%-6% of total indoor heat exchanger) second condenser will increase evaporator capacity by 12% and moisture condensation by more than 30%. Second factor is that the second condenser warms up outgoing air, further reducing RH.

However, reduction in evaporating temperature causes some reduction in efficiency. With the second condenser surface of 5-6% from total indoor heat exchanger surface efficiency drop is around 2-2.5%. Compared to other means for air humidity reduction, such as aforementioned reduction in airflow, or in the evaporator surface, or heating air after the evaporator with an additional heater or a part of condensing coil, it's still relatively low price. In most applications, the second condenser occupying 5-6% of indoor heat exchanger will be enough. However, the tubes of the second condenser shall be located in a way that at least most of the air leaving the evaporator has to be reheated in a second condenser.

Figure 8:
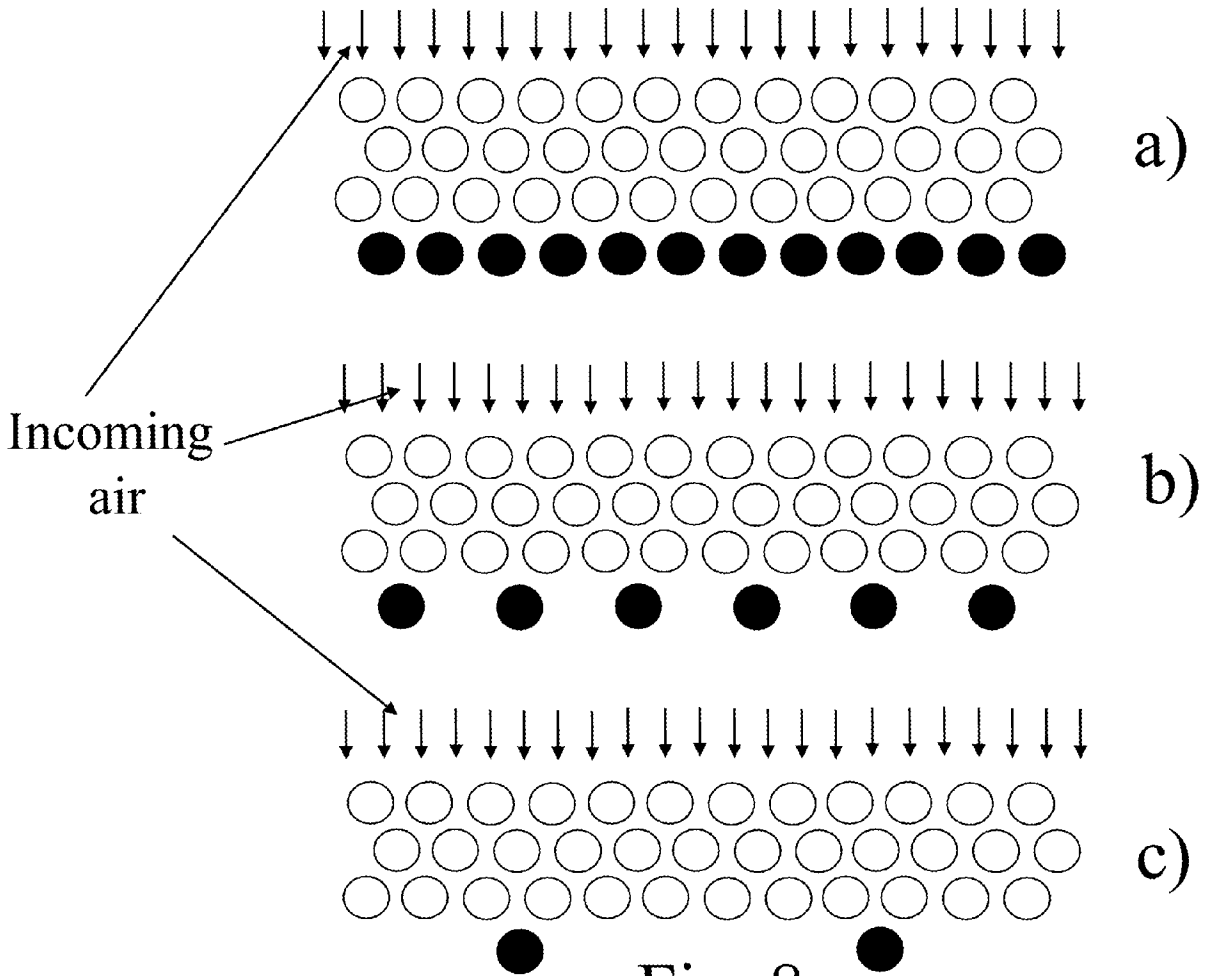
FIG. 8 is an arrangement of tubes in an indoor heat exchanger of an air conditioner of FIG. 4 and heat pump of FIGS. 5, 6.

FIGS. 8*a*, 8*b*, 8*c* demonstrate ways to arrange main and auxiliary sections in an indoor heat exchanger. In the schematics, tubes of the main section are not filled and tubes of the auxiliary section are filled with black color. The arrangement in FIG. 8*a* includes 3 rows of the main (evaporating) section of the indoor coil and one extra row occupied by the auxiliary coil. In this arrangement auxiliary coil takes 25% of total indoor heat exchanger surface. If the main section consisted of 2 rows and auxiliary heat exchanger still occupied one row, the second condenser would take one third of the total indoor heat exchanger tubing. As shown in FIG. 7, further increase in auxiliary heat exchanger dimensions is irrational: COP sharply going down while reduction in leaving evaporator air relative humidity below 70% is not necessary. The arrangement of tubes in FIG. 8*b* again includes 3 rows of the evaporator and a half row of the second condenser that here occupies around 14% of indoor heat exchanger. What's important is that tube distribution in the row occupied by the auxiliary section has to be as even as possible. This provides an opportunity to reheat most of the air leaving the evaporator. Finally, in arrangement of FIG. 8*c*, second condenser takes only 5.2% of the indoor heat exchanger. If air is well mixed in the indoor heat exchanger before the auxiliary coil, this will be enough to reduce relative humidity of air after evaporator.

Figure 9:
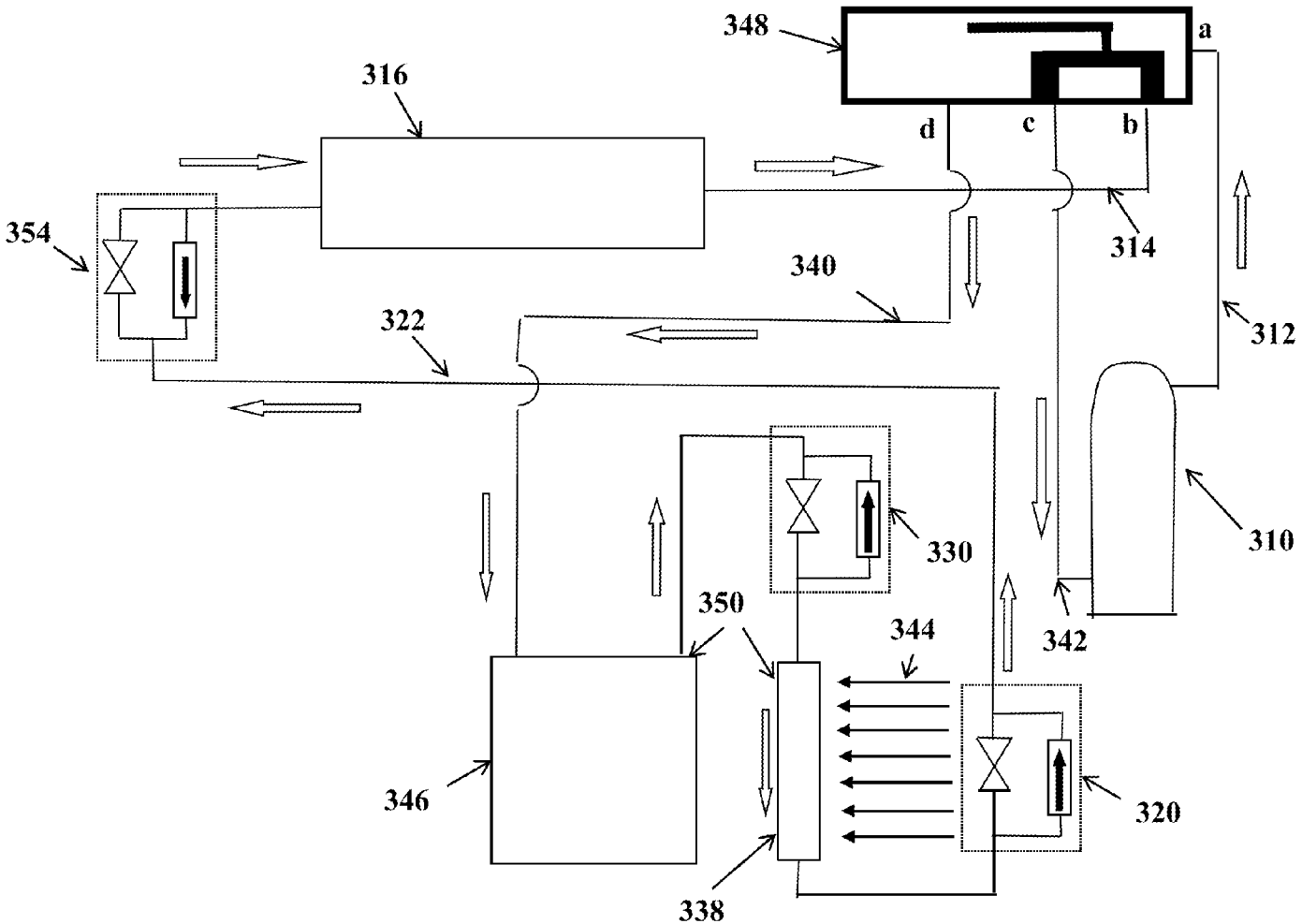
FIG. 9 is a schematic of a heat pump according to another embodiment of the invention operating in heating mode per refrigeration cycle of FIG. 1.

FIG. 9 depicts a sealed system of a heat pump operating in heating mode. Compared to a conventional heat pump, in this mode the system provides extra capacity and efficiency. Hot compressed refrigerant vapor after compressor 310 through line 312 flows to port a of 4-way reversing valve 348. In the heating mode, refrigerant from port a flows to port d and further through line 340 to main section 346 of indoor heat exchanger 350 that in this mode operates as a first condenser, desuperheating and condensing refrigerant vapor and rejecting heat to indoor air stream. After the first condenser 346 liquid refrigerant flows through a second expansion device 330, expands in this device and reaches an auxiliary section 338 that operates as a second condenser, condensing refrigerant vapor after the second expansion device 330 and rejecting heat to incoming air 344. Further refrigerant flows to a first expansion device 320. In this mode the first expansion device allows refrigerant to flow to line 322 without expansion. Then a third expansion device 354 expands refrigerant. After expansion mostly liquid refrigerant reaches an outdoor heat exchanger 316, which in this mode operates as an evaporator. After evaporator 316, refrigerant vapor through line 314 reaches port b of reversing valve 348. Then, through port c and line 342, vaporized refrigerant comes to the compressor suction. The design of anyone of the expansion devices maybe a cap tube, an orifice, or a thermostatic expansion valve with an additional check valve allowing free refrigerant movement in one direction. It could be also a short tube restrictor or any other expansion device expanding refrigerant in one direction and allowing free flow in the opposite direction. In some heat pumps where, for example, indoor and outdoor heat exchangers are in proximity, the third and the first expansion devices could be combined in one apparatus that expands refrigerant in cooling mode in one direction and in heating mode in the opposite direction. The second expansion device 330 may be combined with a distributor (not shown) if main section 346 of the indoor heat exchanger consists of several parallel passes. In addition, sealed system of this heat pump also, as others described in the present invention, may include filter, dryer, accumulator, and other sealed system parts.

Figure 10:
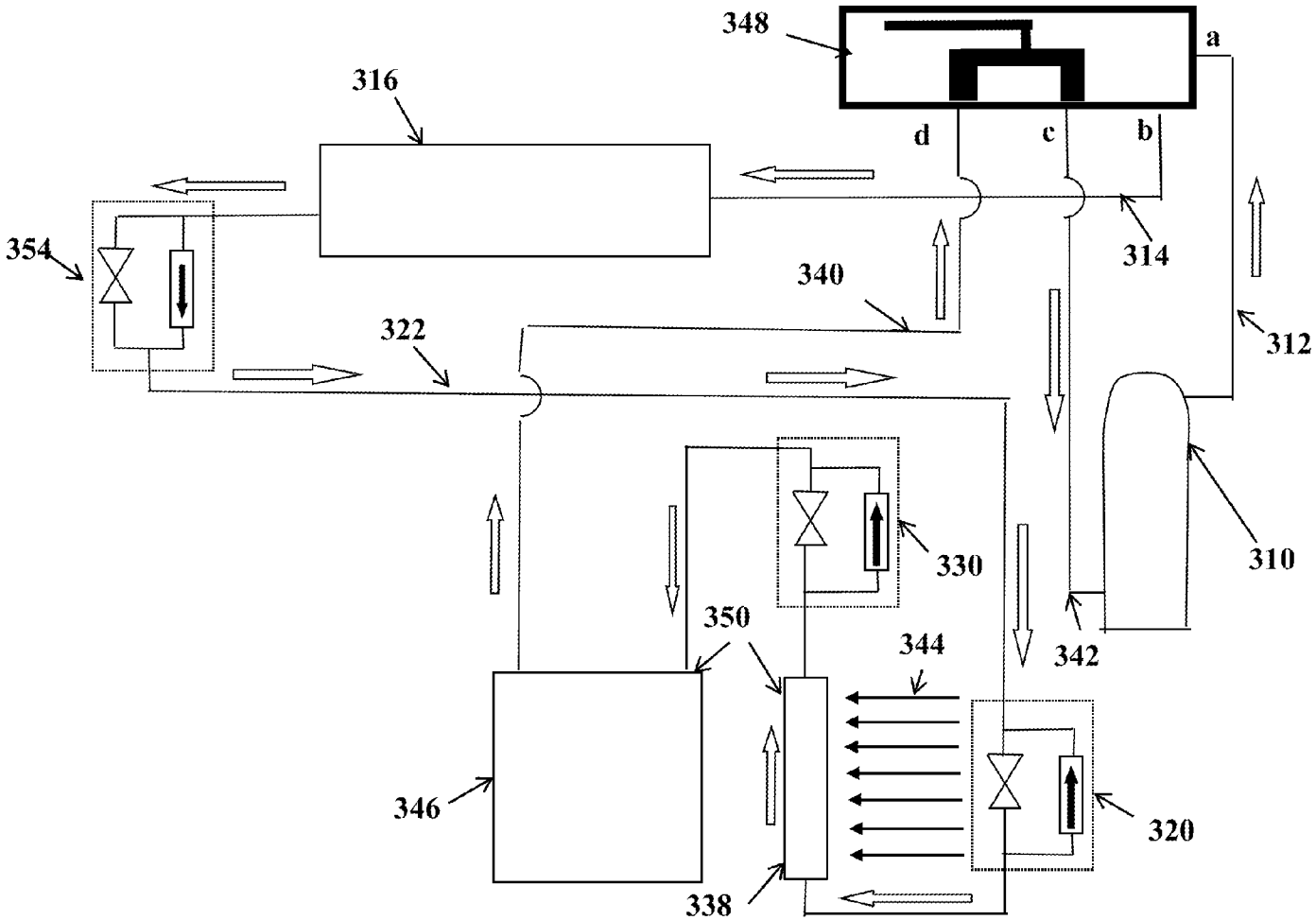
FIG. 10 is a schematic of the heat pump of FIG. 9 operating conventional refrigeration cycle in cooling mode.

FIG. 10 shows refrigerant path in the sealed system of heat pump of FIG. 9 operating in cooling mode. Hot refrigerant vapor flows from compressor 310 discharge to port a of 4-way valve 348 through line 312. In this mode, refrigerant after port a flows to port b and further through line 314 to outdoor heat exchanger 316, that operates as a condenser, desuperheating and condensing refrigerant and rejecting heat to ambient. After condenser 316, refrigerant moves to the first expansion device 320 through the third expansion device 354 and line 322. In this direction, expansion device 354 allows refrigerant flowing without expansion, while expansion device 320 expands refrigerant before auxiliary section 338 of the indoor heat exchanger 350 that operates as a first part of the evaporator. After auxiliary heat exchanger 338, refrigerant reaches the second expansion device 330 and further, the main section 346. In this mode, expansion device 330 allows refrigerant flowing through without expansion while the section 346 operates as a second part of the evaporator. Thus, both sections 346 and 338 of heat exchanger 350 work as a single evaporator, evaporating liquid refrigerant and absorbing heat from indoor airflow 344. After evaporator vaporized refrigerant flows through line 340 and reaches port d of reversing valve 348, then through port c and line 342 refrigerant goes to suction port of compressor 310. Thus, in this mode, heat pump operates according to the conventional refrigeration cycle depicted in FIG. 2.

Figure 11:
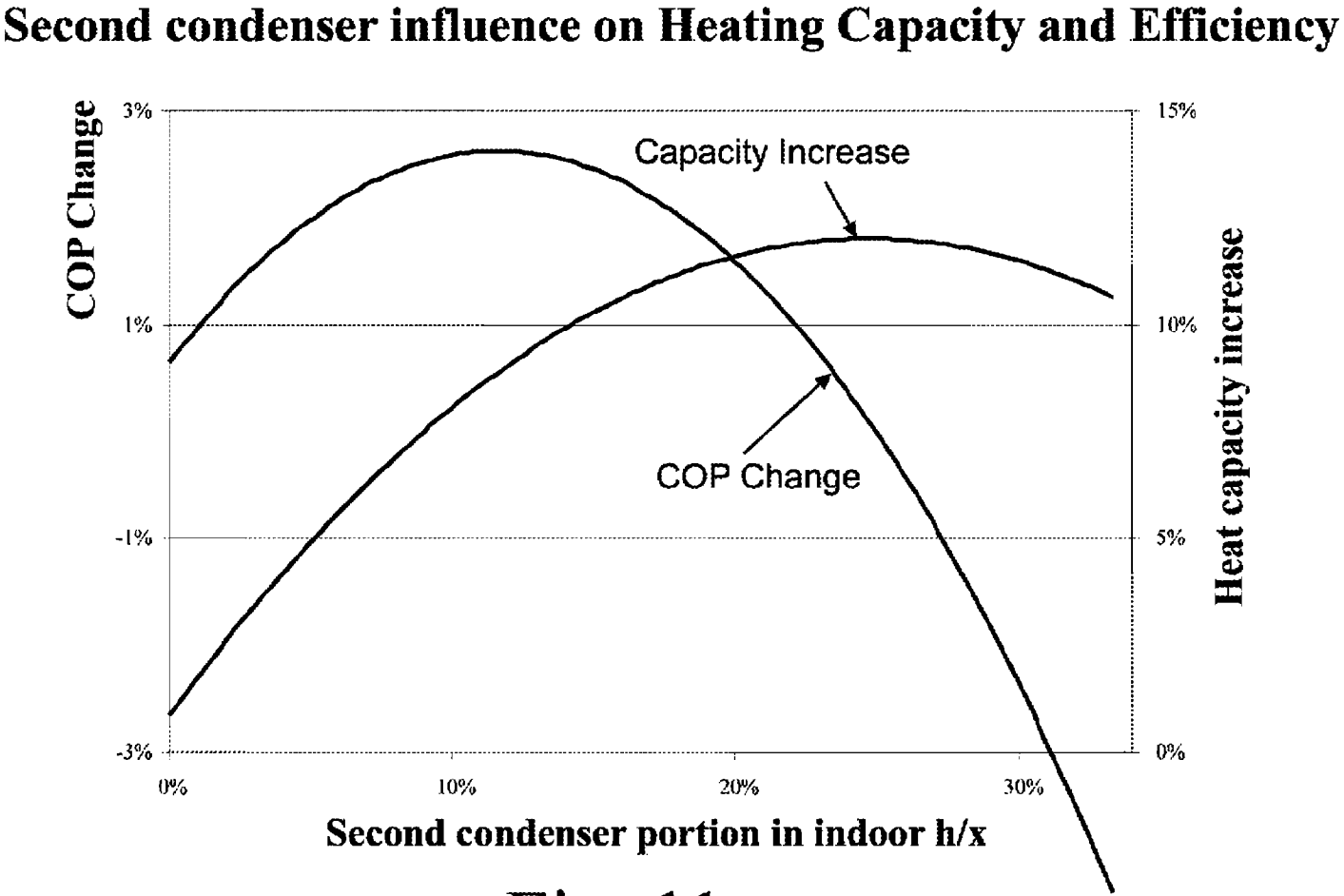
FIG. 11 presents results of math modeling of efficiency and heating capacity of the heat pump of FIG. 9.

FIG. 11 shows results of math modeling of heat pump of FIG. 9 in heating mode. Again, as for air conditioner of FIG. 4 an important design parameter is what portion of indoor heat exchanger shall be used as an auxiliary section or as a second condenser. The rest of the indoor heat exchanger is the main section that in this mode works as a first condenser. The assumptions include: refrigerant is R410A, indoor air temperature is 68 deg. F., when operating in conventional refrigeration cycle condensing temperature is 110 deg. F. and evaporating temperature is 40 F. As it can be seen from FIG. 11, the schematics may provide around 12% in capacity increase and almost 3% increase in efficiency. Best efficiency is achieved when auxiliary coil takes 10-15% of total indoor heat exchanger surface while largest capacity is achieved if auxiliary coil is around one forth of the indoor heat exchanger. Thus, the best range for auxiliary section of indoor heat exchanger is between 5% and 25%. The chart demonstrates that if the auxiliary section exceeds one third of total indoor heat exchanger surface, the efficiency drops by more than 4% while heating capacity also starts decreasing.

Figure 12:
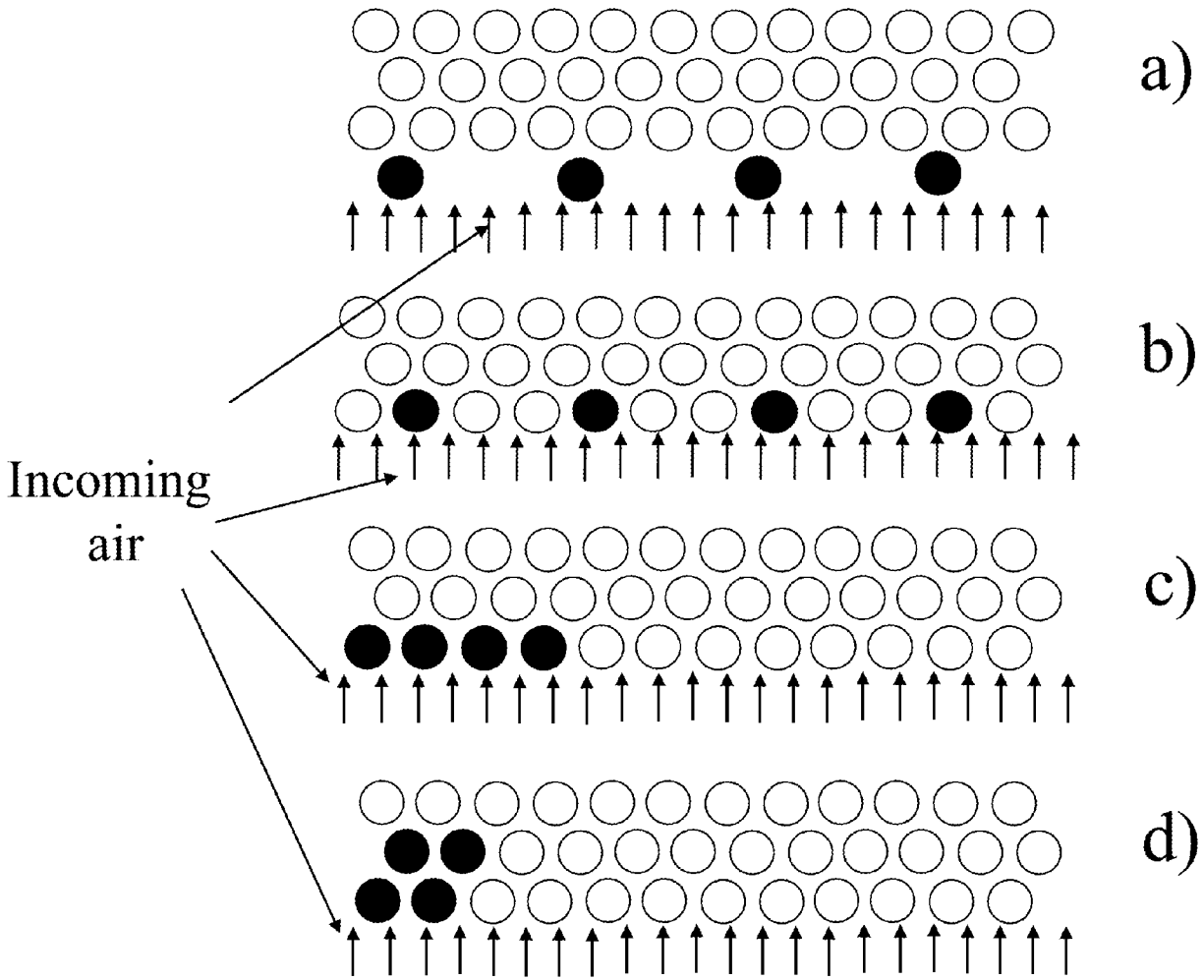
FIG. 12 is an arrangement of tubes in an indoor heat exchanger of the heat pump of FIGS. 9,10.

FIGS. 12*a*, 12*b*, 12*c*, and 12*d* represent different tube arrangements in the heat pump of FIGS. 9 and 10. In all four arrangements, the number of tubes in the auxiliary section (tubes filled with black color) of indoor heat exchanger is 4 that is 10% of 40 tubes in FIGS. 12*a* and 11% of 36 tubes in FIGS. 12*b*, 12*c*, 12*d*. Here, unlike the arrangement in FIG. 8, the auxiliary section of the indoor heat exchanger has to be at the air inlet. The best solution is to spread tubes of auxiliary heat exchanger evenly before the main section of the indoor heat exchanger (FIG. 12*a*). However, there are no such strict requirements as for arrangement in FIG. 8 and auxiliary heat exchanger tubes can be located between tubes of main heat exchanger (FIG. 12*b*), in one end (FIG. 12*c*), or even partly occupy a couple of first (in the direction of air) rows (FIG. 12*d*). Still, efficiency will gradually worsen from arrangement of FIG. 12*a* through arrangement of FIG. 12*d*.

Figure 13:
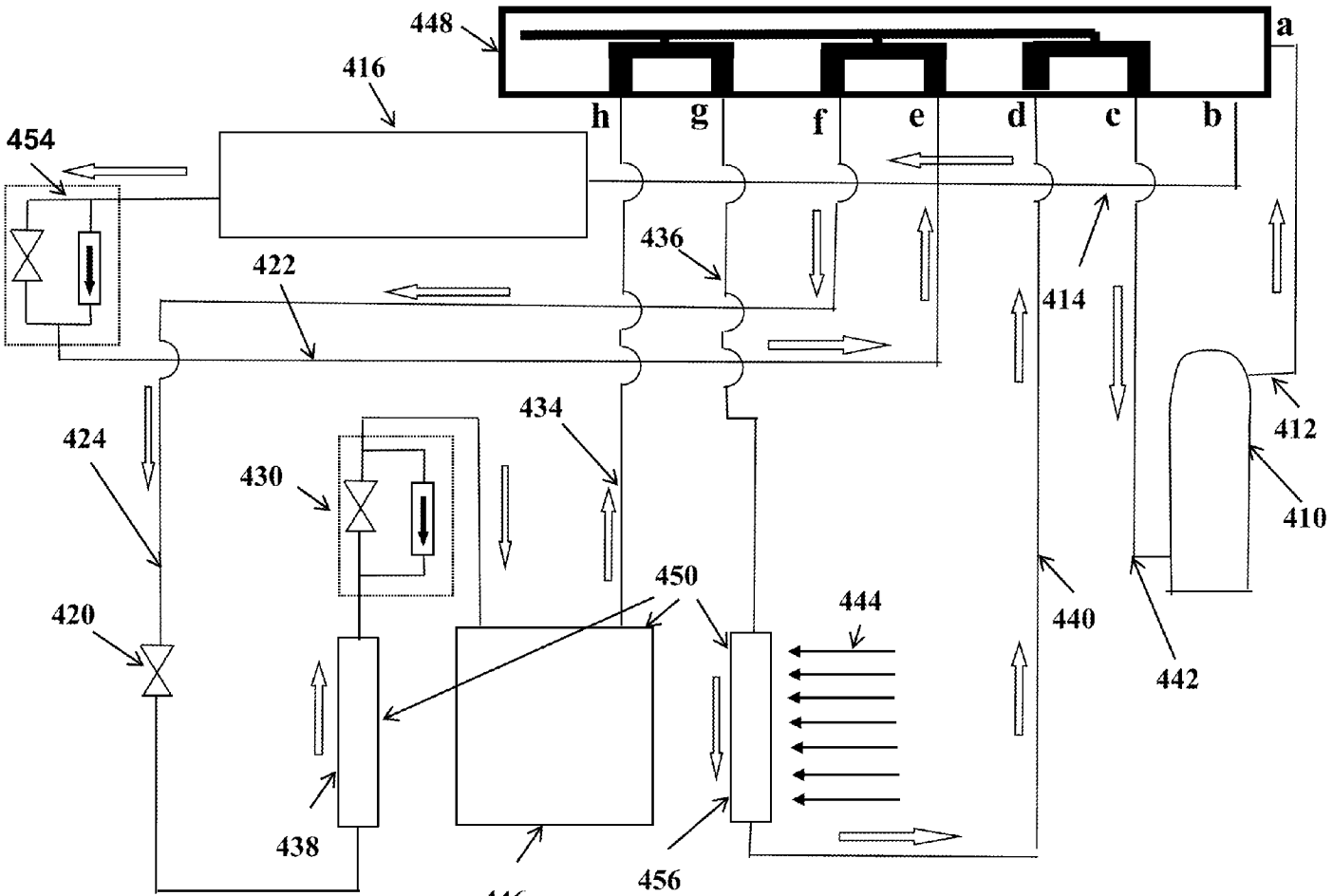
FIG. 13 is a schematic of a heat pump according to yet another embodiment of the invention operating in cooling mode per refrigeration cycle of FIG. 1.
Figure 14:
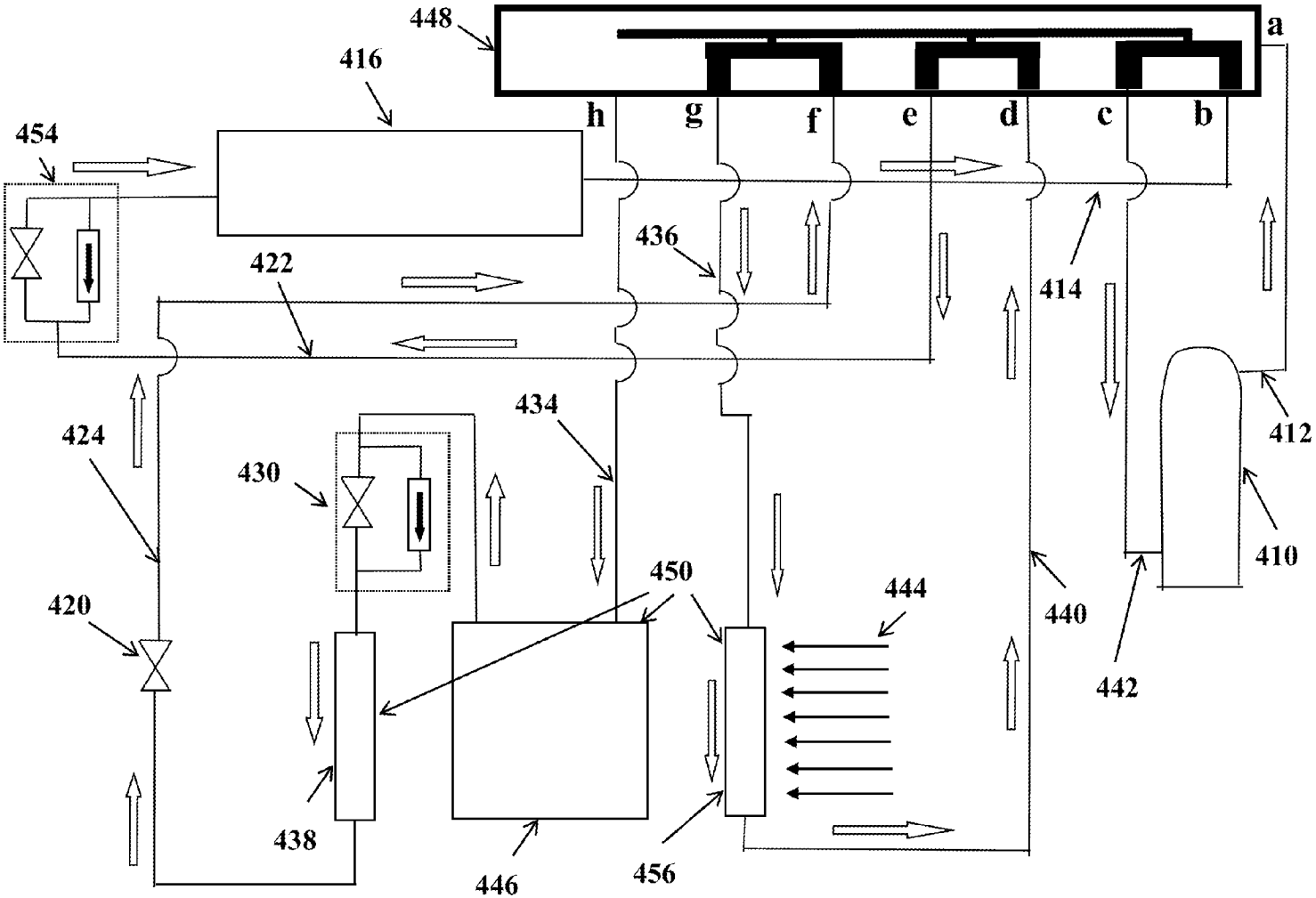
FIG. 14 is a schematic of the heat pump of FIG. 13 operating refrigeration cycle of FIG. 1 in heating mode.

FIGS. 13 and 14 show a heat pump operating with cascade expansions in both cooling and heating modes.

FIG. 13 shows schematics in cooling mode operations. Hot refrigerant vapor after compressor 410 through line 412 flows to port a of an 8-way reversing valve 448. Then, through port b and line 414, refrigerant reaches outdoor heat exchanger 416. In this mode, heat exchanger 416 operates as a first condenser rejecting heat to ambient, desuperheating refrigerant vapor and condensing this vapor. Liquid refrigerant after condenser 416 flows through a third expansion device 454 that in this direction allows refrigerant flow without expansion. Then, through line 422, refrigerant reaches port e of reversing valve 448. Further, refrigerant flows through port f and line 424 to a first expansion device 420, expanding refrigerant in both directions. Expanded refrigerant flows to a first auxiliary section 438 of indoor heat exchanger 450, which operates as a second condenser, recondensing vapor after the first expansion device 420 and rejecting heat to cold air leaving indoor heat exchanger. After the second condenser 438, liquid refrigerant expands again, now in a second expansion device 430. Expanded refrigerant flows to a main section 446 of indoor heat exchanger 450, which operates as a first part of evaporator, evaporating liquid refrigerant and absorbing heat and condensing moisture from indoor air. After heat exchanger 446, refrigerant flows to port h of reversing valve 448 through line 434. Then, through port g and line 436, refrigerant flows to a second auxiliary section 456 of indoor heat exchanger 450, which operates as the last part of the evaporator, vaporizing the rest of liquid refrigerant and absorbing heat and condensing moisture from incoming air 444. After evaporator 456, vaporized refrigerant flows to port d of 8-way reversing valve 448 through line 440 and through port c and line 442 reaches compressor suction. In this schematics the first expansion device 420 is an apparatus that expands refrigerant in cooling mode in one direction and in heating mode in the opposite direction. The design of second and third expansion devices may include cap tubes, orifices, or thermostatic expansion valves with additional check valves allowing free refrigerant movement in one direction. It could also be short tube restrictors or any other expansion devices expanding refrigerant in one direction and allowing free flow in the opposite direction. The second expansion device 430 may be combined with a distributor (not shown), if main section 446 of indoor heat exchanger consists of several parallel passes. In addition, sealed system of this heat pump also, as others described in the present invention, may include filter, dryer, accumulator, and other sealed system parts.

FIG. 14 is a schematic of heat pump of FIG. 13 operating in heating mode. Hot refrigerant vapor after compressor 410 flows to port a of 8-way reversing valve 448 through line 412. Then, through port h and line 434, refrigerant reaches main section 446 of indoor heat exchanger 450. In this mode, section 446 operates as a first part of a first condenser, desuperheating and partly condensing refrigerant vapor and rejecting heat to indoor airflow. After heat exchanger 446, refrigerant freely flows through second expansion device 430 to reach a first auxiliary section 438 that now operates as a second part of the first condenser, condensing the rest of refrigerant vapor and rejecting heat to outgoing airflow. Liquid refrigerant after section 438 expands in first expansion device 420 and, through line 424 flows to port f, then to port g and through line 436 to the second auxiliary section 456 of indoor heat exchanger 450 that now operates as a second condenser. In section 456, refrigerant recondenses, rejecting heat to incoming indoor airflow 444. After section 456, liquid refrigerant through line 440, ports d and e flows to third expansion device 454 wherein it expands. After expansion, liquid refrigerant evaporates in outside heat exchanger 416, absorbing heat from ambient. After evaporator 416, vaporized refrigerant reaches compressor suction through ports b, c, and line 442.

Design of FIGS. 13, 14 could be different. For example, first expansion device 420 could be designed a way to expand refrigerant only in one direction and an additional device expanding refrigerant in the opposite direction is to be installed in line 436. However, relative to airflow to be conditioned the second condenser in the cooling mode has always to be downstream of the evaporator and in the heating mode, the second condenser has to be upstream of the first condenser.

While preferred embodiments of the invention have been describe above in details, it will be understood that many modifications can be made to the illustrated systems without departing from the spirit and scope of the invention.

What I claim is:

1. A method for cooling, dehumidification, and heating air with a refrigeration system including a refrigerant circuit and an air circuit; the refrigerant circuit including a compressor, a first and second heat exchangers, said first heat exchanger consisting of an auxiliary section and a main section, a first and second expansion devices with the first expansion device located between the first and second heat exchangers and the second expansion device located between the auxiliary and the main sections of the first heat exchanger; the air circuit including a fan moving air to be conditioned, the method for operation: in a conventional cooling mode, in a cooling mode with enhanced dehumidification, in a conventional heating mode, and in an improved heating mode with increased capacity and efficiency, the method including the steps:

in the conventional cooling mode:

compressing refrigerant vapor in the compressor, condensing refrigerant vapor after the compressor in the second heat exchanger, expanding refrigerant in the first expansion device, evaporating a part of liquid refrigerant in the auxiliary section of the first heat exchanger while absorbing heat from conditioning air, flowing refrigerant through the second expansion device without expansion, evaporating the rest of liquid refrigerant in the main section of the first heat exchanger while absorbing heat from conditioning air, returning vapor refrigerant to the compressor, moving conditioning air first through the main section and then through the auxiliary section;

in the cooling with enhanced dehumidification mode:

compressing refrigerant in the compressor, condensing refrigerant vapor after the compressor in the second heat exchanger, expanding liquid refrigerant in the first expansion device, condensing refrigerant vapor after expansion in the auxiliary section of the first heat exchanger while rejecting heat to conditioning air, expanding refrigerant in the second expansion device, evaporating liquid refrigerant in the main section of the first heat exchanger while absorbing heat from conditioning air, returning vapor refrigerant to the compressor, moving air first through the main section and then through the auxiliary section;

in the conventional heating mode:

compressing refrigerant in the compressor, partly condensing refrigerant vapor after the compressor in the main section of the first heat exchanger while rejecting heat to conditioning air, flowing refrigerant through the second expansion device without expansion, condensing the rest of refrigerant vapor in the auxiliary section of the first heat exchanger while rejecting heat to conditioning air, expanding refrigerant in the first expansion device, evaporating liquid refrigerant in the second heat exchanger, returning vapor refrigerant to the compressor, moving air first through the auxiliary section and then through the main section;

in the improved heating mode:

compressing refrigerant in the compressor, condensing refrigerant vapor after the compressor in the main section of the first heat exchanger while rejecting heat to conditioning air, expanding liquid refrigerant in the second expansion device, condensing refrigerant vapor after expansion in the auxiliary section of the first heat exchanger while rejecting heat to conditioning air, expanding refrigerant in the first expansion device, evaporating liquid refrigerant in the second heat exchanger, returning vapor refrigerant to the compressor, moving air first through the auxiliary section and then through the main section.

2. A refrigeration system (heat pump) for conditioning air operating in two heating modes: in a conventional heating mode and in an improved heating mode with increased capacity and efficiency, the system including an air circuit with a fan for moving air to be conditioned and a refrigerant circuit, the refrigerant circuit including in serial connections:

a compressor for compressing refrigerant vapor;

a first heat exchanger for conditioning air with two sections:

a main section operating as a first part of a single condenser in the conventional heating mode and as a first condenser in the improved heating mode;

an auxiliary section operating as a second part of the single condenser in the conventional heating mode and as a second condenser in the improved heating mode;

a second heat exchanger, operating as an evaporator;

a first expansion device located between the first and the second heat exchangers in proximity to the second heat exchanger expanding refrigerant before the second heat exchanger;

a second expansion device located between the auxiliary and the main sections of the first heat exchanger, said second expansion device expanding refrigerant in the improved heating mode and allowing refrigerant to flow through without expansion in the conventional heating mode;

lines for flowing refrigerant from the compressor through the first and second heat exchangers and the expansion devices back to the compressor;

refrigeration system auxiliary parts: a dryer, an accumulator, and/or a receiver.

3. The system of claim 2 wherein the second expansion device includes a bypass line with a shutoff valve that in opened position allows refrigerant to flow through without expansion.

4. The system of claim 2 wherein heat transfer surface of the auxiliary section of the first heat exchanger is equal to or smaller than one third of total surface of the first heat exchanger.

5. The system according to claim 4 wherein the first heat exchanger consists of several rows of tubes arranged in a way that at least a part of the auxiliary section occupies at least a part of the first in the direction of airflow row.

6. The system according to claim 5 wherein the first heat exchanger is an indoor heat exchanger and the second heat exchanger is an outdoor heat exchanger.

7. The system according to claim 6 operating in a conventional cooling mode, the system comprising:

a reversing valve to change the direction of refrigerant flow through the indoor and the outdoor heat exchangers and, accordingly, the system operating modes from heating to cooling and vice versa in a way that in the conventional cooling mode the outdoor heat exchanger operates as a condenser and the indoor heat exchanger operates as a single evaporator with the auxiliary section operating as a first part of the evaporator and the main section operating as a second part of the evaporator;

the first expansion device allowing refrigerant to flow through without expansion in the conventional cooling mode;

the second expansion device allowing refrigerant to flow through without expansion in the conventional cooling mode;

a third expansion device located in proximity to the indoor heat exchanger expanding refrigerant in the conventional cooling mode and allowing refrigerant to flow through without expansion in the heating modes.

8. The system of claim 7 wherein the first and the third expansion devices are combined in a single apparatus.

9. A refrigeration system for conditioning air operating in two cooling modes: in a conventional cooling mode and in a cooling mode with enhanced dehumidification, the system including an air circuit with a fan for moving air to be conditioned and a refrigerant circuit, the refrigerant circuit including in serial connections:

a compressor for compressing refrigerant vapor;

a first heat exchanger for conditioning air with at least two sections:

an auxiliary section operating as a first part of a single evaporator in the conventional cooling mode and as a second condenser in the cooling mode with enhanced dehumidification;

a main section operating as a second part of the evaporator in the conventional cooling mode and as a single evaporator in the cooling mode with enhanced dehumidification;

a second heat exchanger operating as a condenser;

a first expansion device located between the first and the second heat exchangers in proximity to the first heat exchanger expanding refrigerant before the auxiliary section of the first heat exchanger;

a second expansion device located between the auxiliary and the main sections of the first heat exchanger, said second expansion device expanding refrigerant in the cooling mode with enhanced dehumidification and allowing refrigerant to flow through without expansion in the conventional cooling mode;

lines for flowing refrigerant from the compressor through the first and second heat exchangers and the expansion devices back to the compressor;

refrigeration system auxiliary parts: a dryer, an accumulator, and/or a receiver.

10. The system according to claim 9 wherein the first heat exchanger is an indoor heat exchanger and the second heat exchanger is an outdoor heat exchanger.

11. The system according to claim 10 wherein the indoor heat exchanger consists of several rows of tubes arranged in a way that at least a part of the auxiliary section occupies at least a part of the last in the direction of airflow row.

12. The system of claim 11 wherein the main section of the indoor heat exchanger is a multi-circuit heat exchanger and contains a distributor that is between the auxiliary section and the main section.

13. The system according to claim 11 wherein heat transfer surface of the auxiliary section of the indoor heat exchanger is equal to or smaller than one third of total surface of the indoor heat exchanger.

14. The system of claim 13 wherein the second expansion device includes a bypass line with a shutoff valve that in opened position allows refrigerant to flow through without expansion.

15. The system according to claim 13 operating in a conventional heating mode, the system comprising:

a reversing valve to change refrigerant flow direction through the indoor and the outdoor heat exchangers and accordingly, the system operating modes from cooling to heating and vice versa in a way that in the conventional heating mode outdoor heat exchanger operates as an evaporator and the indoor heat exchanger operates as a single condenser with the main section operating as a first part of the condenser and the auxiliary section operating as a second part of the condenser, the first expansion device allowing refrigerant flowing through without expansion in the conventional heating mode;

the second expansion device allowing refrigerant flowing through without expansion in the conventional heating mode;

a third expansion device located in proximity to the outdoor heat exchanger expanding refrigerant in the conventional heating mode and allowing refrigerant to flow through without expansion in the cooling modes.

16. The system of claim 15 wherein the first and the third expansion devices are combined in a single apparatus.

17. The system according to claim 10 operating in an improved heating mode, the system including a refrigerant circuit and an air circuit, the refrigerant circuit comprising:

the outdoor heat exchanger operating in the heating mode as the evaporator;

the indoor heat exchanger with a first and a second auxiliary sections and the main section located between said first and second auxiliary sections;

the first expansion device expanding refrigerant flowing to the second auxiliary section in the heating mode;

the second expansion device located between the first auxiliary section and the main section of the indoor heat exchanger allowing refrigerant to flow through without expansion in the heating mode;

a third expansion device located in proximity to the outdoor heat exchanger allowing refrigerant to flow through without expansion in the cooling modes and expanding refrigerant in the heating mode;

a multi-way reversing valve connecting the compressor, the indoor and the outdoor heat exchangers and expansion devices and changing the system operating modes from cooling to heating and vice versa directing refrigerant in the heating mode:

from the compressor discharge to the main section of the indoor heat exchanger, from the main section to the first auxiliary section bypassing expansion in the second expansion device with both main and first auxiliary sections operating as the first condenser, after the first auxiliary section to the first expansion device, after expansion in the first expansion device to the second auxiliary section operating as the second condenser, after the second auxiliary section to the third expansion device, from the third expansion device to the outdoor heat exchanger operating as the evaporator, after the outdoor heat exchanger to the compressor suction;

and in the cooling modes:

from the compressor discharge to the outdoor heat exchanger, from the outdoor heat exchanger to the first expansion device bypassing expansion in the third expansion device, after the first expansion device to the first auxiliary section of the indoor heat exchanger, after the first auxiliary section to the second expansion device, after the second expansion device to the main section of the indoor heat exchanger, after the main section to the second auxiliary section, after the second auxiliary section of the indoor heat exchanger to the compressor suction;

and the air circuit including a fan for moving air to be conditioned first against the second auxiliary section, then against the main section, and last against the first auxiliary section of the indoor heat exchanger.

18. The system of claim 17 wherein the main section of the indoor heat exchanger is a multi-circuit heat exchanger and contains a distributor between the first auxiliary section and the main section.

19. The system according to claim 17 wherein heat transfer surface of each of the first and second auxiliary sections of the indoor heat exchanger is equal to or smaller than one third of total surface of the indoor heat exchanger.

* * * * *